US005353518A

United States Patent [19]

Lee

[11] Patent Number: 5,353,518

[45] Date of Patent: Oct. 11, 1994

[54] IMPLEMENT TO BLOT GREASE FROM SOLID FOODSTUFF

[76] Inventor: Ling H. Lee, 6496 Heather Dr., Memphis, Tenn. 38119

[21] Appl. No.: 72,053

[22] Filed: Jun. 7, 1993

[51] Int. Cl.[5] ..... F26B 19/00

[52] U.S. Cl. ..... 34/89.1; 34/95; 34/92

[58] Field of Search ..... 34/15, 92, 89.1, 95, 34/71, 9; 99/369, 403, 444, 495

[56] References Cited

U.S. PATENT DOCUMENTS 2,164,614 7/1939 Lynn ..... 34/89.1
3,048,938 8/1962 Mears ..... 34/95
3,852,891 12/1974 Stephan ..... 34/95
4,383,376 5/1983 Numamoto ..... 34/95
5,199,186 4/1993 Rice et al. ..... 34/92

*Primary Examiner*—Henry A. Bennet

[57] ABSTRACT

This invention discloses a simple and inexpensive household implement to blot grease from one lot of prepared solid foodstuff, particularly deep-fried articles. It comprises an air-evacuating pump connected to a openable, closable, disposable, and flexible plastic bag interiorly lined with a layer of flexible liquid-absorbing material. Upon activation of said pump, blotting action occurs after the closed bag and the layer of liquid-absorbing are packed tightly against the greasy articles.

6 Claims, 1 Drawing Sheet

IMPLEMENT TO BLOT GREASE FROM SOLID FOODSTUFF

FIELD OF THE INVENTION

This invention pertains to a simple and inexpensive household implement to blot away grease from one lot of solid foodstuff.

BACKGROUND, PURPOSE, AND BRIEF SUMMARY OF THE INVENTION

From nutritional and culinary points of view, it is highly desirable to remove as much as possible coated grease on prepared solid foodstuff, particularly deep-fried food. Currently there are two methods: (1) gravity draining of grease from fried food is not adequate; (2) paper blotting of fried food is too tedious. The purpose of this invention is to provide a convenient and inexpensive implement to blot grease from prepared greasy foodstuff such as deep-fried articles in lots. Briefly, after a flexible, openable, and closable plastic bag lined interiorly with a flexible liquid-absorbing material is evacuated with an air-evacuating pump means, said bag and liquid-absorbing lining collapse tightly against the contents.

DETAILED DESCRIPTION OF THE INVENTION

Figure 1:
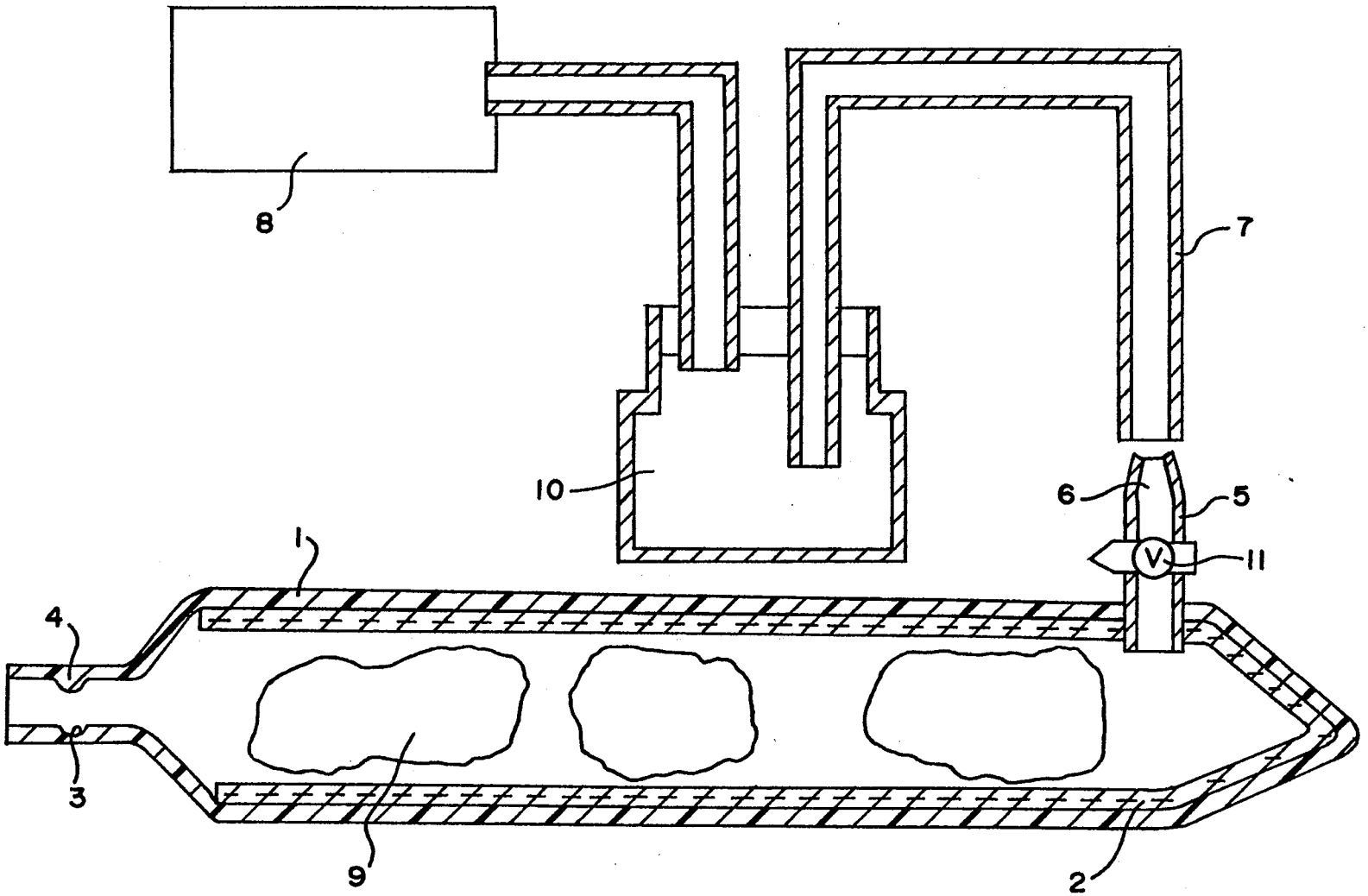
FIG. 1 is a cross-sectional view of a preferred embodiment.

To accomplish abovementioned purpose and referring to FIG. 1, an openable and closable flexible plastic bag 1 is lined in its interior surface by adhesive means a layer of liquid-absorbing material 2, such as tissue paper. The mechanism for openable and closable plastic bag is well known, such as the groove(3)-and-ridge(4) type, bearing a brand name of Ziploc. A nipple 5 with a hollow lumen 6 is installed at one edge of bag 1, Onto the exterior end of nipple 5 is temporarily connectable and disconnectable tubing 7 the other end of which is permanently connected to a air-evacuating pump means 8. To operate, one fills bag I with greasy foodstuff 9, closes mechanism 3 and 4, and connects tubing 7 to nipple 5. Upon activation of pump means 8, excessive grease on foodstuff 9 is blotted onto liquid-absorbing material 2 as bag 1 and said layer of liquid-absorbing material 2 are packed tightly against foodstuff 9. To improve efficacy, under certain circumstances, such as various sizes, quantity, and configuration of foodstuff 9, it may be necessary to repeat the operation after opening bag 1, and re-distribute the contents. Bag 1, liquid-absorbing material 2, and the blotted grease are then discarded.

As an alternative operation, one may place additional pieces of loose tissue papers among the food articles prior to closing of the bag.

A manually operated open-or-shut valve 11 may be built into nipple 5, for the purpose of maintaining vacuum in bag 1 after tubing 7 is disconnected from nipple 5. Such a feature is desirable, for example, for carry-out fried food from eating places.

A trap bottle 10 and associated tubing may be installed between pump means 8 and nipple 5 for the purpose of preventing grease and food particles from entering pump means 8.

It should be understood that this disclosure is merely illustrative, that improvements and refinements may be instituted, and that the accompanying claims cover obvious derivatives thereof insofar as they conform the spirit and scope of this invention.

I claim:

1. An implement to blot coated grease from prepared solid foodstuff articles comprising:

(a) a openable and closable bag, for purpose of containing said prepared foodstuff articles, said bag being made of flexible plastic, (b) for purpose of blotting grease from said foodstuff, a layer of soft and flexible liquid-absorbing material adhering to interior surfaces of said bag, (c) at one edge of said bag, a nipple having a hollow lumen communicating with interior space of said bag, and (d) for purpose of creating vacuum in said bag, an air-evacuating pump means connectable to and disconnectable from said nipple, such that, after said closed bag being filled with greasy said solid foodstuff articles, and after connecting said pump means to said nipple, activation of said pump means causes said layer of liquid-absorbing material and said bag to collapse tightly against said foodstuff articles and to blot grease from said foodstuff articles.

2. An implement as set forth in claim 1 therein said pump means being further defined to include a tubing means between said pump means and said nipple for purpose conducting evacuating action between said pump means and said nipple.

3. An implement as set forth in claim 1 therein a trap bottle being interposed between said pump means and said nipple for purpose of trapping any grease and food particles from entering said pump means.

4. An implement as set forth in claim 1 therein mechanism of said openable and closable bag is defined to be groove-and-ridge zipper.

5. An implement as set forth in claim 1 therein said nipple is defined to include a manually operated open-or-shut valve for purpose of controlling patency of lumen of said nipple.

6. A method of degreasing foodstuff articles by placing loose pieces of tissue papers among said foodstuff articles prior to closing of said bag as set forth in claim 1.

* * * * *